United States Patent [19]

Misevich et al.

[11] 3,956,844

[45] May 18, 1976

[54] LOADING DEVICE FOR A TUBULAR PROJECTILE

[75] Inventors: Kenneth W. Misevich, Fairfield, Conn.; Henry G. Tucker, Westfield, Mass.

[73] Assignee: Remington Arms Company, Inc., Bridgeport, Conn.

[22] Filed: Sept. 11, 1974

[21] Appl. No.: 504,972

[52] U.S. Cl. ..... 42/90; 42/87

[51] Int. Cl.[2] ..... F41C 27/00

[58] Field of Search ..... 42/87, 88, 89, 90

[56] References Cited

UNITED STATES PATENTS

| | | | |
|---|---|---|---|
| 163,404 | 5/1875 | Phillips | 42/90 |
| 391,811 | 10/1888 | Mixter | 42/87 |
| 3,747,252 | 7/1973 | Walker | 42/90 |

*Primary Examiner*—Charles T. Jordan

*Attorney, Agent, or Firm*—John H. Lewis, Jr.; Nicholas Skovran; William L. Ericson

[57] ABSTRACT

A plurality of tubular projectiles are held in a container. A stem is withdrawn from one end of the container until it engages a plunger. After the other end of the container is placed in a launcher, the stem is pushed into the container forcing the plunger to move the projectiles toward the launcher, the projectile closest to the launcher being transferred from the container and properly positioned in the launcher for firing.

5 Claims, 7 Drawing Figures

LOADING DEVICE FOR A TUBULAR PROJECTILE

This invention relates to tubular projectiles and, more specifically, to a loading device for inserting one of a plurality of projectiles into a suitable launcher.

It has long been desired to develop nonhazardous projectiles which are capable of use in the control of civil disturbances without presenting a substantial danger of serious injury to participants and yet can effectively quell and disperse the riot. One such projectile is disclosed in U.S. Patent Application Ser. No. 504,971 filed Sept. 11, 1974 by Kenneth W. Misevich and assigned to the assignee of this invention.

A substantial problem of this type projectile is that it is not readily adapted to automatic or semiautomatic feeding into a launcher preparatory to firing and, therefore, individual projectiles must be inserted into a suitable launcher. However, if it is necessary to utilize such a projectile, a series of projectiles may have to be fired in rapid succession. Thus, rapid and sure loading of projectiles into the launcher must be provided.

In accordance with this invention, a loading clip holds a plurality of projectiles and may be utilized to swiftly insert a plurality of projectiles seriatim into a suitable launcher. Prior to use, a stem of the loading device is in a retracted position. When withdrawn, it engages a plunger which is constructed to permit motion of the stem therethrough in one direction and prevent motion in the other direction. The loading device is inserted into a launcher and the stem pushed back into the loading device. This moves a plunger, which is also constructed for unidirectional motion within the device, and forces one of the projectiles from the loading device into the launcher.

The advantages of this invention will be more readily apparent when the following Specification is read in conjunction with the appended drawings, wherein.

Figure 1:
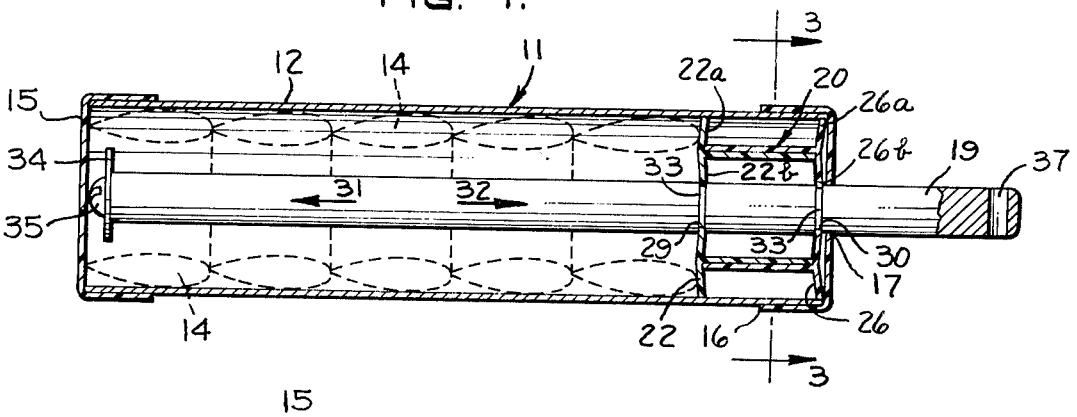
FIG. 1 is a cross-sectional view of the loading device of this invention.
Figure 2:
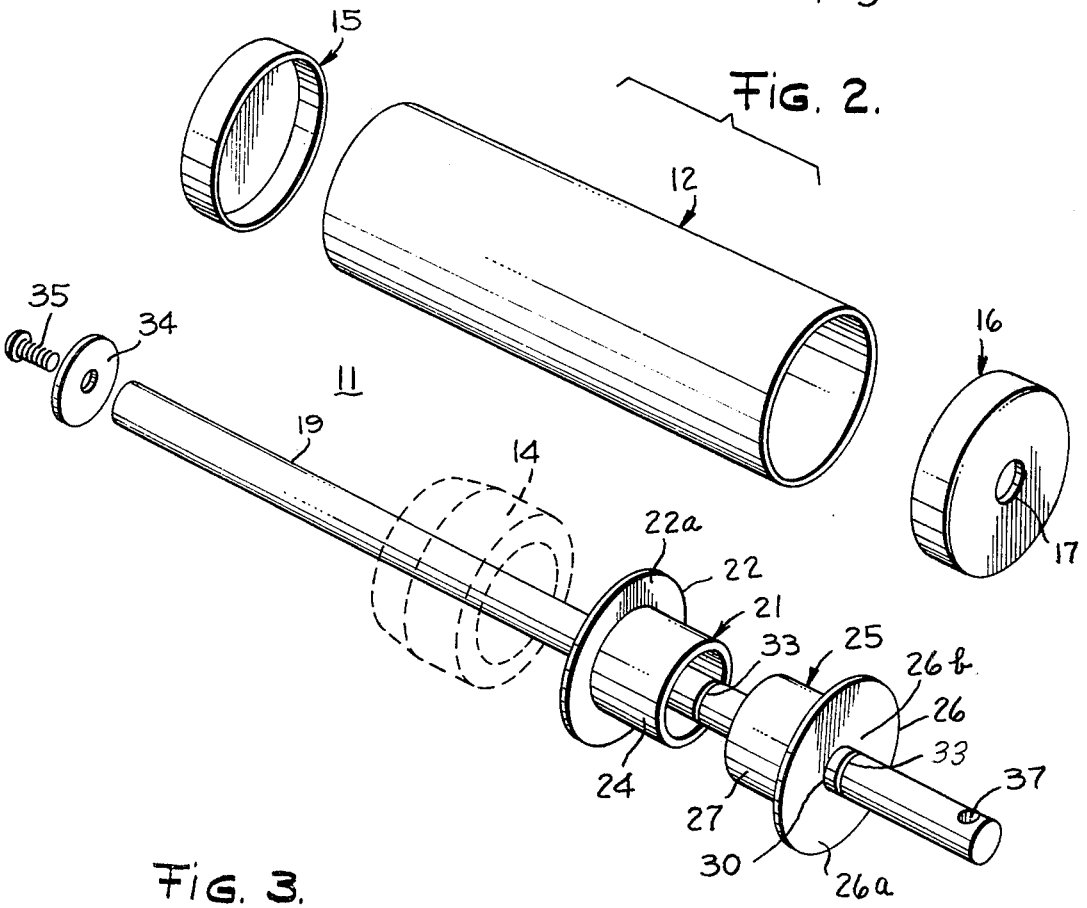
FIG. 2 is an exploded perspective view of the loading device of FIG. 1.
Figure 3:
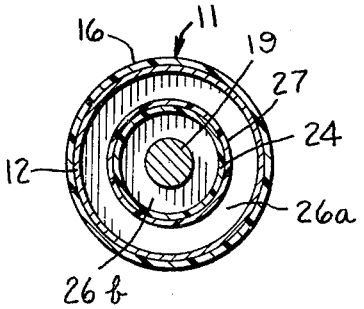
FIG. 3 is a cross-sectional view taken substantially along the line 3—3 of FIG. 1.

Referring now to the drawings, a loading device 11 in accordance with this invention is illustrated in FIGS. 1-3 and has a tubular container or body 12 suitable for containing a plurality of projectiles 14. A suitable projectile 14 for use in conjunction with the loading device 11 is described in the above-identified U.S. Patent application Ser. No. 504,971 and is preferably a tubular, molded rubber projectile which may be adapted to carry a payload for delivery on impact with a target. The body 12 is preferably cylindrical in shape and may be made of a metal such as aluminum or steel or of a rigid plastic or other suitable structural material. The inner diameter of the body 12 is determined by the diameter of the projectiles 14 to be held therein, substantial contact between the projectiles and the inner surface of the body being preferred. The length of the body 12 is generally dependent on the number of projectiles sought to be held therein and the outer diameter must permit it to be positioned for loading a suitable launcher.

End caps 15 and 16 are preferably mounted at the forward and rear ends, respectively, of the body 12. The rear end cap 16 preferably has a centrally located opening 17 therein to accommodate passage of a stem 19 therethrough. The end caps 15 and 16 would preferably seal the loading device 11 to prevent injurious materials from entering and possibly causing damage to the projectiles 14 held therein.

A plunger 20 is initially positioned in the rear end portion of the body 12 and may be molded of plastic in two parts. A forward plunger section 21 has a forward plunger wall 22 and a tubular forward interlocking portion 24; a rear plunger section 25 has a rear plunger wall 26 and a rear interlocking portion 27. The interlocking portions 24 and 27 should have similar shapes, preferably generally cylindrical and have equal lengths. The outer diameter of one of the interlocking portions is preferably about equal to the inner diameter of the other interlocking portion so that they can be interfitted to form a firm and securely assembled plunger 20. The interlocking portions are preferably substantially smaller in diameter than the plunger walls 22 and 26 so that the plunger walls are divided into an outer portion **22*a*, 26*a* and an inner portion 22*b*, 26*b*. A pair of centrally located aligned openings 29 and 30 are provided in the forward plunger wall 22 and rear plunger wall 26, respectively, to accommodate passage of the stem 19.**

The plunger walls 22 and 26 preferably have an outer diameter slightly larger then the inner diameter of the body 12 and the plunger walls are formed with the outer portions **22*a* and 26*a* flared outwardly and rearwardly and with the inner portions 22*b* and 26*b* bowed rearwardly toward the center. The openings 29 and 30 in the bowed inner portions preferably fit fairly tightly around the stem 19.**

The bowed and flared portions of the forward and rear plunger walls interact with the body 12 and stem 19 and result in a novel and highly efficient mode of operation for the loading device 11. The stem 19 is not restricted by its relationship with the opening 17 in the rear end cap 16 so that it may move forwardly, in the direction shown by an arrow 31 in FIG. 1, or rearwardly, in a direction shown by an arrow 32 in FIG. 1, with respect to the body 12. Other relative movements are restricted, however, by the particular configuration of the forward and rear plunger walls 22 and 26.

When the stem 19 is moved in the direction shown by the arrow 32, the stem frictionally interacts with the sides of the openings 29 and 30. This tends to push the inner portions **22*b* and 26*b* of the plunger walls in the direction in which it is already bowed. It will be readily apparent that this interaction urges the edges of the openings 29 and 30 outwardly away from the stem 19 and in no way restricts the motion of the stem. However, when the stem 19 is moved in the direction shown by the arrow 31, frictional interaction between the stem and the sides of the openings 29 and 30 tends to urge the inner portions 22*b* and 26*b* of the plunger walls in a direction opposite to the bowing, thus urging the edges of the openings 29 and 30 inwardly and increasing the frictional interaction with the stem. This results in a binding action locking the plunger to the stem and preventing motion of the stem in the direction shown by the arrow 31 with respect to the plunger 20.**

A similar situation exists between the plunger 20 and the body 12. Because the outer portions 22*a* and 26*a* of the plunger walls are flared rearwardly and outwardly (or to the right as shown in FIG. 1), forward motion of the plunger 20, in particular motion in the direction shown by the arrow 31, is not impeded because the outer plunger wall portions only produce light frictional interaction with the body 12. However, if an attempt is made to move the plunger in the direction shown by the arrow 32, the frictional interaction causes the outer plunger wall portions 22*a* and 26*a* to attempt to straighten so that the outer edges move further outwardly and increase the frictional interaction with the body 12. Thus, the plunger is locked against motion in the direction shown by the arrow 32 with respect to the body 12.

When the loading device is in the configuration illustrated in FIG. 1 with the plunger 20 at the rear end portion of the body 12 and the stem 19 positioned fully forward in the body 12, the stem 19 can, as previously explained, be easily moved in the rearward direction shown by the arrow 32. While the plunger is held in a pair of grooves 33 which prevent any relative motion of the plunger 20 and stem 19 before use, the stem when pulled easily frees itself from this detent for loading operation. To prevent its being pulled completely through the plunger 20 and out through the rear end cap 16, a suitable detent means, such as a washer 34 and screw 35, is provided at a forward end portion of the stem. When the stem has been withdrawn to the point where the washer 34 engages the forward plunger wall 22, further motion of the stem in the direction shown by the arrow 32 is prevented. In addition, because of the interaction previously described between the stem 19 and the inner plunger wall portions 22*b* and 26*b*, motion of the stem 19 in the direction shown by the arrow 31 is prevented with respect to the plunger 20. Thus, when the stem 19 has been withdrawn fully rearwardly, it becomes locked in position with respect to the plunger 20.

If the stem 19 is now moved forwardly, i.e., in the direction shown by the arrow 31, it carries the plunger 20 with it. As has been previously explained, the plunger is free to move only in that direction. Thus, the stem 19 and plunger 20 are free to move in the forward direction along the full length of the body 12. Interaction of the outer plunger wall portions 22*a* and 26*a* with the body 12, however, prevents any motion of the plunger and stem in the rearward direction shown by the arrow 32.

Figure 4:
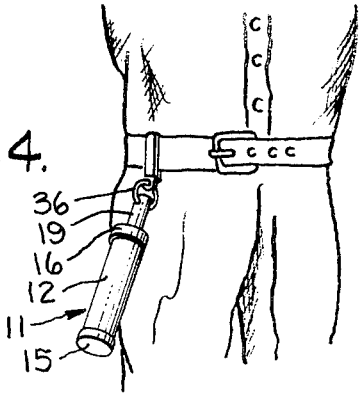
FIG. 4 is a fragmentary illustration showing the loading device of FIG. 1 in a storage position prior to use.
Figure 5:
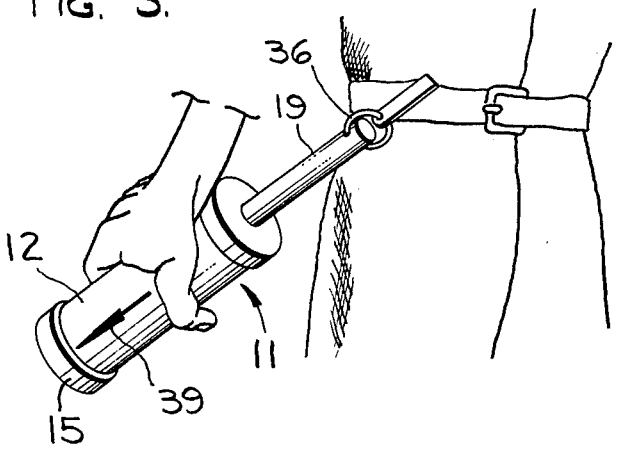
FIG. 5 is a fragmentary illustration similar to FIG. 4 showing a stem of the loading device being extended during use.

Operation of the loading device 11 can best be described with additional reference to FIGS. 4–7. Preparatory to use, the loading device 11, loaded with a plurality of projectiles, may be suspended from a belt as shown in FIG. 4 by use of a ring 36 or other device inserted through a suitable bore 37 in the stem 19. By grasping the body 12 as shown in FIG. 5 and moving the body in the direction shown by an arrow 39 in FIG. 5, the stem 19 is moved from the position shown in FIG. 1 to the fully extended position with the washer 34 engaging the forward plunger wall. By removing the forward end cap 15 and disconnecting the stem 19 from the ring 36, the loading device is readied for operation.

Figure 6:
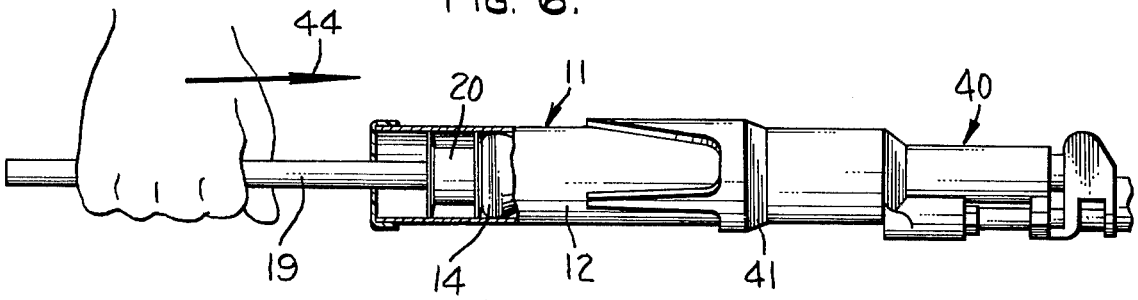
FIG. 6 is a plan view, partially cut away, showing use of the loading device of FIG. 1 for loading of a projectile into a suitable launcher.
Figure 7:
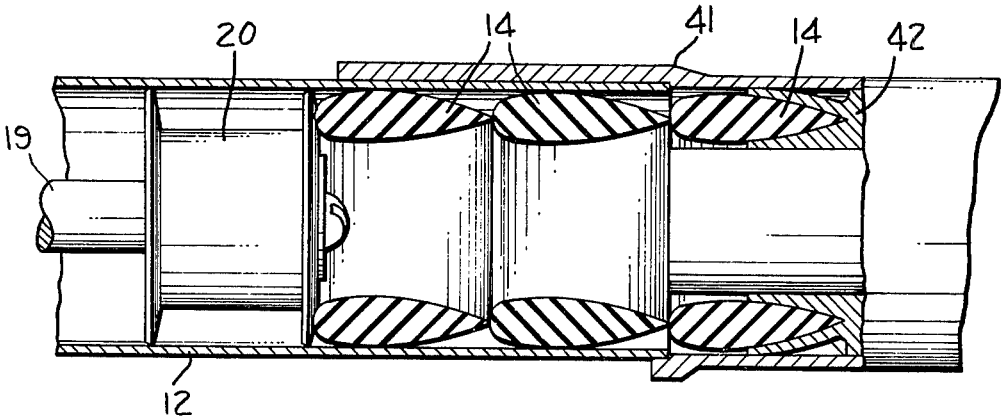
FIG. 7 is a fragmentary cross-sectional view of the loading device further illustrating its operation.

A suitable launcher 40 is illustrated in FIGS. 6 and 7. While the details of construction of a launcher 40 are not relevant to the loading device of this invention, one appropriate launcher is described in detail in the above-identified Patent application Ser. No. 504,971. The launcher 40 has a generally tubular forward portion 41 which houses a piston 42 shaped to hold a single projectile 14.

As can be seen in FIGS. 1 and 7, the projectiles 14 are aligned in the body 12 with a rear end portion of the projectile forwardly disposed in the loading device. This permits the projectiles 14 to be properly inserted, rear end first, into the launcher 40 when the loading device 11 is inserted into the launcher as shown in FIG. 6. The loading device may be held by grasping the stem 19 with one hand while the body 12, preferably having an outer diameter slightly less than the inner diameter of the tubular forward portion 41 of the launcher 40, is inserted into the launcher by movement in the direction shown by an arrow 44 in FIG. 6. When motion of the body 12 has stopped, continued motion of the stem 19 in the direction shown by the arrow 44 moves the plunger 20 through the body 12 to push the projectiles 14 toward the piston 42. This motion stops when one projectile 14 has been seated in the piston 42 as is illustrated in FIG. 7. At this point, the other projectiles 14 are still firmly held within the body 12 of the loading device 11 for easy withdrawal and storage.

By pulling the stem 19 outwardly from the launcher 40, the entire loading device 11 is withdrawn because the washer 34 and screw 35 prevent relative motion of the stem 19 and plunger 20 and the interaction of the outer plunger wall portions and the body 12 prevent relative motion between the plunger 20 and the body 12. Upon removal, the loading device 11 may again be suspended from the ring 36 or placed in any convenient location so that the next projectile 14 can be rapidly loaded when needed. If it is not anticipated that additional projectiles will be needed for some time, the forward end cap 15 may be replaced on the body 12 at the option of the user.

It should be readily apparent that structural variations may be possible in the loading device without departing from the spirit and scope of this invention. For example, instead of utilizing the forward end cap 15, the loading device could be sealed by use of a circular piece of flexible plastic or other material secured to the stem beneath the screw 35 and releasably secured in a sealing configuration to the forward end of the body 12. Upon withdrawal of the stem 19 from the body in the manner shown in FIG. 5, such a forward cover would be automatically removed exposing the projectiles for loading. Additionally, the plunger 20 may be formed in alternative configurations. For example, each of the forward plunger wall 22 and rear plunger wall 26 could be formed as a separate section and joined to a tubular central portion by any desired means, such as by ultrasonic welding.

We claim:

1. A loading device for loading a projectile in a launcher, said loading device comprising a container for holding a projectile, plunger means mounted in the container for motion in one direction and having means for preventing motion of said plunger means in an other direction, stem means slidably mounted in said plunger means for motion therethrough in said other direction, means for limiting motion of said stem means in said other direction at a predetermined position, and means for preventing motion of said stem means through said plunger means in said one direction.

2. A loading device as in claim 1 wherein said plunger means has forward and rear plunger walls having diameters not less than said container and outer portions of said plunger walls are flared toward said other direction to prevent motion of said plunger means in said other direction.

3. A loading device as in claim 2 wherein inner portions of said plunger walls are bowed in said other direction to prevent motion of said stem means through said plunger means in said one direction.

4. A loading device as in claim 3 wherein said plunger means comprises a forward portion including said forward plunger wall and a forward interlocking portion, and a rear portion including said rear plunger wall and a rear interlocking portion, and said front and rear interlocking portions interengage to maintain structural integrity of said plunger means.

5. A loading device as in claim 1 including a pair of sealing means secured to opposite end portions of said container, one of said sealing means being releasably secured to said container and the other of said sealing means having an opening to accommodate passage of said stem means.

* * * * *